United States Patent [19]

Lumen

[11] 4,181,187

[45] Jan. 1, 1980

[54] ROCK DRILL BIT WITH STRESS RELIEF INSERT SOCKETS

[75] Inventor: Karl L. G. Lumén, Sandviken, Sweden

[73] Assignee: Sandvik Aktiebolag, Sandviken, Sweden

[21] Appl. No.: 880,993

[22] Filed: Feb. 24, 1978

[30] Foreign Application Priority Data

Mar. 3, 1977 [SE] Sweden ..... 7702345

[51] Int. Cl.[2] ..... E21C 13/00; E21C 13/08

[52] U.S. Cl. ..... 175/410; 175/413; 299/91

[58] Field of Search ..... 175/374, 409, 410, 412, 175/413; 403/41; 299/91

[56] References Cited

U.S. PATENT DOCUMENTS

| | | | |
|---|---|---|---|
| 2,030,576 | 2/1936 | Erickson | 175/410 X |
| 3,100,545 | 8/1963 | Zimmerman | 175/410 X |
| 3,618,683 | 11/1971 | Hughes | 175/410 |
| 3,807,804 | 4/1974 | Kniff | 175/410 X |
| 3,970,158 | 7/1976 | Black et al. | 175/410 |
| 7,970,002 | 5/1978 | Kidder et al. | 175/410 X |

*Primary Examiner*—Ernest R. Purser

*Assistant Examiner*—Nick A. Nichols, Jr.

*Attorney, Agent, or Firm*—Burns, Doane, Swecker & Mathis

[57] ABSTRACT

A rock drill bit is disclosed of the type comprising a steel body having a plurality of longitudinally extending holes, and a plurality of metal inserts mounted in the holes. Each hole includes a cylindrical steel wall portion, a bottom steel wall portion, and a radially enlarged transition steel wall portion extending between a longitudinally inner end of the cylindrical wall portion and a radially outward end of the bottom wall portion. Each insert includes a cylindrical insert portion directly abutting against the cylindrical wall portion of the hole. A cylindrical surface portion extends longitudinally inwardly at least as far as the longitudinally inner end of the cylindrical wall portion. The transition wall portion of the hole is smoothly curved continuously from the longitudinally inner end of the cylindrical wall portion to the bottom portion. The transition wall portion extends radially outwardly and longitudinally inwardly from the longitudinally inner end of the cylindrical wall portion. This design minimizes the possibility that fatique cracks will develop in the support body adjacent the inner end of the holes.

3 Claims, 6 Drawing Figures

Figure 4:
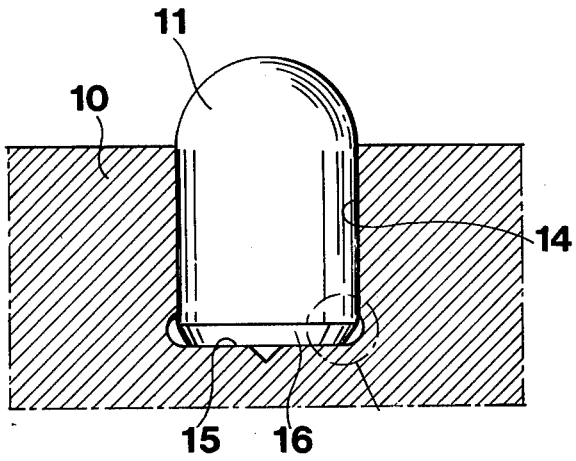

Fig.1
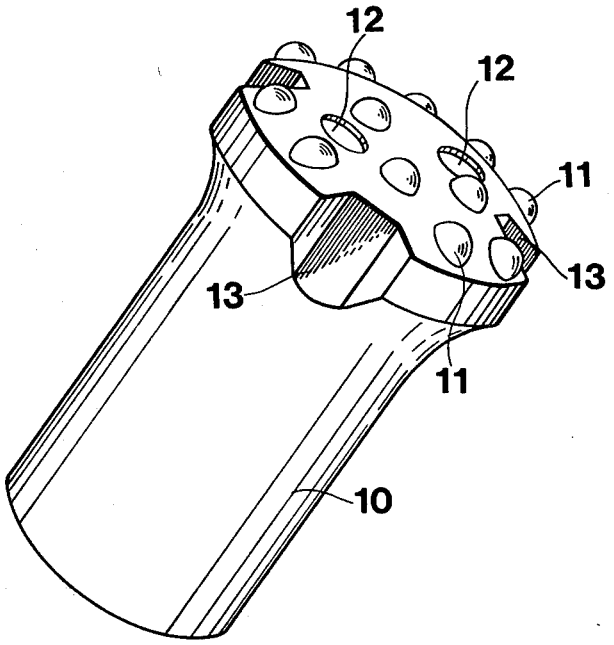
Fig.2 *PRIOR ART*
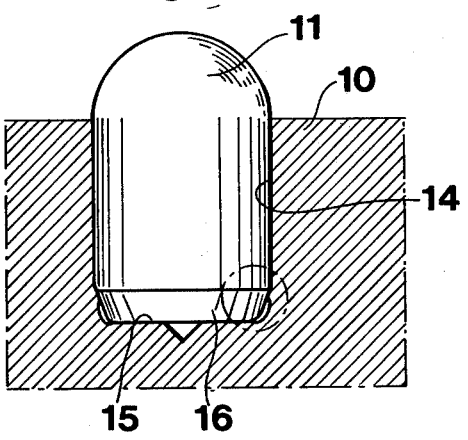
Fig.3 *PRIOR ART*
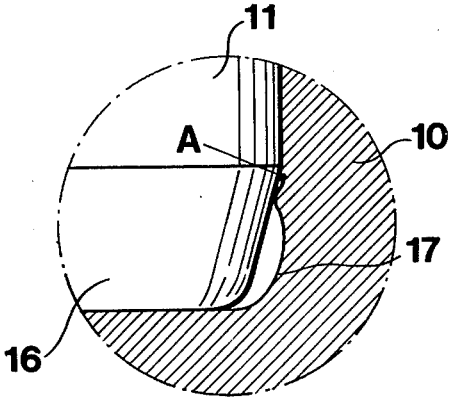

ROCK DRILL BIT WITH STRESS RELIEF INSERT SOCKETS

The present invention relates to a rock drill bit consisting of a metallic body portion of steel having an peripheral front surface equipped with cylindrical hard metal inserts that protrude from interferringly sized holes in said body portion.

Rock drill bits equipped with button shaped inserts are nowadays used to increased extent instead of drill bits with chisel shaped inserts. This development has occurred for several reasons. In the first hand use of button inserts leads to an increased number of contact points between the bit and the bottom of the hole to be drilled which results in a more calm and undisturbed performance of the drill bit at work. At the same time this leads to less strains exerted to the drill equipment. Further, more fine-grained drill cuttings easy to flush away will be produced as a result of using button bits.

When proceeding with further development of drill bits with button inserts it has been observed that insert attachment procedure is primarily responsible for the level to which improvements in the bit life can be reached. Press or interference fit has been found to be the necessary type of insert attachment for reaching as safe attachment as possible between the hard metal inserts and the steel body portion. When the steel bit body proceeds through the hole to be drilled each button insert is subjected to a reaction force from the rock which presses the insert towards the bottom of its hole. The insert is then relieved and an elastic return movement of the insert occurs. For each load cycle a relative movement between insert and bit body thus occurs. This causes deformation to the wall material of the insert-receiving hole exerted by the insert's hard metal, the hardness of which is substantially greater than the hardness of the steel bit body. Due to the tensile forces occurring as a result of the insert's movement which are of fatigue character steel cracks of gradually increasing size develop in said wall material which causes rupture of the steel supporting material such that the inserts come loose and makes the drill bit unusable.

The present invention proposes a new technical solution of insert attachment to its steel body such that development of cracks in the supporting steel material could be prevented and appreciable improvements in the bit life might be reached.

To this end, the wall portions of the insert-receiving holes in the steel body portion are provided with laterally recessed portions between the cylindrical wall and the bottom of said hole such that the cylindrical mantle surface of each insert, located nearest the bottom of the hole, is freely exposed from said wall of said wall of said hole.

The invention will now be explained more in detail with reference to the appended drawings, which illustrate a percussion drill bit according to one embodiment of the invention, in which FIG. 1 is a percussion drill bit of conventional design.

Figure 5:
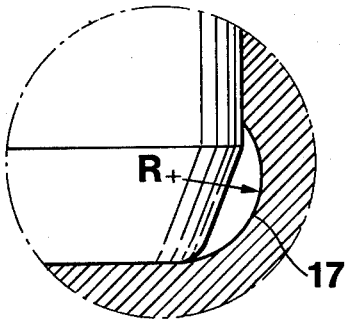
Figure 6:
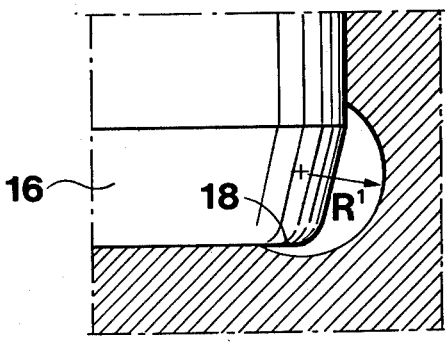

FIG. 2 is a sectional view illustrating a hard metal insert secured to the steel body by interference fit in a conventional manner, FIG. 3 is an enlarged view taken on FIG. 2, FIG. 4 is a sectional view similar to FIG. 2 but illustrating the manner of providing attachment between insert and steel body according to the present invention, FIG. 5 is an enlarged view taken on FIG. 4, and FIG. 6 is an enlarged view similar to FIG. 5 but illustrating an alternative manner of providing attachment between insert and steel body portion according to the present invention.

Referring now to FIG. 1, a percussion drill bit body 10 of steel is shown, the front surface of which is provided with precision-bored holes for receiving cylindrical button inserts 11 of hard metal, usually cemented carbide, thereinto. Each insert 11 has a smoothly rounded protruding end portion. The bit body is additionally provided with flushing channels 12 adjoining to the bit's front surface and peripherally provided recesses 13 to facilitate flushing away drill cuttings from the bottom of the hole to be drilled.

Conventionally each insert 11 is secured to the steel body 10 by being pressed into interferringly sized cylindrical holes 14 such that the insert receives abutment against the bottom 15 of said hole. The lowermost end portion 16 of the insert received in said hole 15 is usually slightly chamfered off conically as shown in FIG. 2. The amount of interference fit between insert and bit body then must be of such great amount that the insert is kept in place during drilling. In spite of the large amount of interference fit used a relative movement always occurs between insert 11 and bit body 10 for each loading cycle as a consequence of the loading force from the rock which initially presses the insert towards the hole buttom 15 whereupon the insert is relieved and an elastic return movement of the insert occurs. This causes deformation to the wall material of the insert-receiving hole 14 due to the differences in hardness between hard metal and steel. This results in a fractural impression at point A in FIG. 3 and development of tensile forces of fatigue character on that point. Rupture of the nearest steel supporting material such that the insert comes loose will be the result thereof.

According to the present invention the transition region 17 between the hole bottom 15 and the hole wall 14 is provided as a laterally recessed portion the extension of which is such that the lowermost cylindrical mantle surface portion of the insert, located nearest the bottom of the hole 14, is freely exposed relative to the surrounding wall portion. The conically chamfered off bottom portion 16 of the insert thus is entirely located within that laterally recessed area 17 as well as a minor cylindrical mantle surface portion of the insert located thereabove.

This laterally recessed portion 17 is suitably produced by turning and provided as a smoothly rounded recess of a certain radius R. It is to be understood, however, that also other configurations of said recess might alternatively be used. Thanks to the above related configuration of the bottom region of the insert-receiving hole it has been found possible to prevent development of steel cracks of fatigue character such as described before.

Referring now to FIG. 6 there is shown a slightly modified embodiment of the invention, with which the bottom region of the insert-receiving hole is laterally recessed with a radius of curvature of such an amount R' that also a portion of the insert's bottom surface 18, located near the transition region between hole bottom and the lowermost wall portion of said hole 14, is exposed within said lateral recess 17.

Having described the preferred embodiment of the drill bit it must be understood that this invention is not to be limited to the precise details shown. It is possible, for instance, to give the insert-receiving hole bottom another configuration than plane as shown in the appended drawings. The principles of the invention may also apply as well to insert-receiving holes provided in earth boring rotatable cutters.

I claim:

1. A rock drill bit comprising:

a steel body including a front peripheral surface, said surface having a plurality of holes extending longitudinally inwardly from said surface, said holes each including:

a steel cylindrical wall portion, a steel bottom wall portion defining the longitudinally inner end of said hole, a radially enlarged steel transition wall portion extending between a longitudinally inner end of said cylindrical wall portion and a radially outward end of said bottom wall portion, a plurality of hard metal inserts mounted in said holes and projecting outwardly of said surface, said inserts each including a side surface comprising:

a cylindrical surface portion directly abutting against said cylindrical wall portion of said hole, said cylindrical surface portion extending longitudinally inwardly at least as far as said longitudinally inner end of said cylindrical wall portion of said hole and terminating short of said bottom wall portion, a tapered surface portion extending longitudinally and radially inwardly from said longitudinally inner end of said cylindrical surface portion, and a radially disposed bottom surface portion defining a longitudinally inner end of said insert said bottom surface portion abutting against said bottom wall portion, said transition wall portion of said hole extending from said longitudinally inner end of said cylindrical wall portion in a longitudinally inward and radially outward direction and later extending longitudinally inwardly and radially inwardly and finally adjoining said bottom wall portion, and having a configuration whose concave portions are smoothly curved to eliminate abrupt concave corners liable to cause localized stress concentrations in the wall of the hole and subsequent fatigue failure therein.

2. A rock drill bit comprising:

a steel body including a front peripheral surface, said surface having a plurality of holes extending longitudinally inwardly from said surface, said holes each including:

a steel cylindrical wall portion, a steel bottom wall portion defining the longitudinally inner end of said hole, and a radially enlarged steel transition wall portion extending between a longitudinally inner end of said cylindrical wall portion and a radially outward end of said bottom wall portion, a plurality of hard metal inserts mounted in said holes and projecting outwardly of said surface, said inserts each including a side surface comprising:

a cylindrical surface portion directly abutting against said cylindrical wall portion of said hole, said cylindrical surface portion extending longitudinally inwardly at least as far as said longitudinally inner end of said cylindrical wall portion of said hole and terminating short of said bottom wall portion, a tapered surface portion extending longitudinally and radially inwardly from said longitudinally inner end of said cylindrical surface portion, and a radially disposed bottom surface portion defining a longitudinally inner end of said insert said bottom surface portion abutting against said bottom wall portion, said transition wall portion of said hole being smoothly curved continuously from said longitudinally inner end of said cylindrical wall portion to said bottom wall portion, and extends in a radially outward and longitudinally inward direction from said longitudinally inner end of said cylindrical wall portion.

3. A rock drill bit according to claim 2, wherein said transition wall portion intersects said bottom wall portion at a location radially inwardly of a longitudinally inner end of said tapered surface portion to expose a radially outer portion of said bottom surface portion of said insert.

* * * * *